US011241897B2

(12) United States Patent
Kitagishi

(10) Patent No.: US 11,241,897 B2
(45) Date of Patent: Feb. 8, 2022

(54) METHOD FOR ADJUSTING PRINTING APPARATUS AND PRINTING APPARATUS

(71) Applicant: SEIKO EPSON CORPORATION, Tokyo (JP)

(72) Inventor: Mikio Kitagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 128 days.

(21) Appl. No.: 16/830,185

(22) Filed: Mar. 25, 2020

(65) Prior Publication Data

US 2020/0307280 A1 Oct. 1, 2020

(30) Foreign Application Priority Data

Mar. 27, 2019 (JP) ..... JP2019-060195

(51) Int. Cl.

| | |
|---|---|
| ***B41J 15/16*** | (2006.01) |
| ***B41J 13/00*** | (2006.01) |
| ***B41J 15/04*** | (2006.01) |
| ***B41J 11/20*** | (2006.01) |

(52) U.S. Cl.

CPC ..... *B41J 15/16* (2013.01); *B41J 11/20* (2013.01); *B41J 13/0009* (2013.01); *B41J 15/046* (2013.01)

(58) Field of Classification Search

CPC ..... B41J 15/16; B41J 11/20; B41J 13/0009; B41J 15/046

See application file for complete search history.

(56) References Cited

U.S. PATENT DOCUMENTS

| | | | | |
|---|---|---|---|---|
| 2011/0180204 | A1* | 7/2011 | Flynn | B65C 9/262 156/247 |
| 2013/0188000 | A1* | 7/2013 | Kitagishi | B41J 11/06 347/104 |
| 2017/0001456 | A1* | 1/2017 | Nakata | B41J 11/00244 |
| 2017/0253056 | A1* | 9/2017 | Sakai | B41J 11/70 |
| 2017/0282612 | A1 | 10/2017 | Takahashi et al. | |
| 2018/0244086 | A1* | 8/2018 | Yoneyama | B65H 31/02 |
| 2019/0016162 | A1* | 1/2019 | Shibata | B65H 19/10 |
| 2019/0366748 | A1* | 12/2019 | Yamane | B41J 11/14 |

FOREIGN PATENT DOCUMENTS

| | | |
|---|---|---|
| JP | 2016-049721 | 4/2016 |

* cited by examiner

*Primary Examiner* — David H Banh
(74) *Attorney, Agent, or Firm* — Workman Nydegger

(57) ABSTRACT

A method for adjusting a printing apparatus, which the printing apparatus includes: a platen for supporting the medium, an imaging unit, a winding shaft for winding the medium, a shaft adjusting mechanism configured to adjust the position of the winding shaft, and a notifying unit configured to perform notification, comprising: a jig installing step for attaching one end of a strip-shaped jig, on which graduations are formed, to the winding shaft, and locking the jig to the platen, along a transporting path at both ends in a width direction of the medium, an imaging step for imaging the graduations by the imaging unit at two locations different from each other, in a direction orthogonal to a transport direction of the medium on the platen, a notifying step for notifying a result based on an image imaged by the imaging unit, and an adjusting step for adjusting the shaft adjusting mechanism.

7 Claims, 7 Drawing Sheets

METHOD FOR ADJUSTING PRINTING APPARATUS AND PRINTING APPARATUS

The present application is based on, and claims priority from JP Application Serial Number 2019-060195, filed Mar. 27, 2019, the disclosure of which is hereby incorporated by reference herein in its entirety.

BACKGROUND

1. Technical Field

The present disclosure relates to a method for adjusting printing apparatus and a printing apparatus.

2. Related Art

Conventionally, a printing apparatus that prints images, characters, and the like on a medium transported in a roll-to-roll manner is known. For example, JP-A-2016-49721, in order to improve the positional accuracy of the medium in a transporting path of the medium, discloses a liquid discharging device as a printing apparatus in which an unwinding unit that unwinds a roll-shaped medium and a winding unit for winding a roll-shaped medium are attached to a common member.

The printing apparatus needs to adjust the length of the transporting path along both ends in a width direction of the medium when assembling the printing apparatus or modifying deformation due to aging. However, the adjustment of the transporting path length, since the operator was visually performed, variations may occur in the adjustment results of the transporting path length.

SUMMARY

A method for adjusting a printing apparatus according to the present disclosure, which the printing apparatus includes: a head configured to discharge a droplet to a medium, a medium supporting unit configured to support the medium facing the head, an imaging unit configured to capture, facing the medium support unit, an image, a winding shaft for winding the medium, a shaft adjusting mechanism configured to adjust the position of the winding shaft, and a notifying unit configured to perform notification about information of a device, comprising: a jig installing step for attaching one end of a strip-shaped jig, on which a measurement pattern is formed, to the winding shaft, and locking the jig to the medium supporting unit, along a transporting path at both ends in a width direction of the medium, an imaging step for imaging the measurement pattern by the imaging unit at two locations different from each other, in a direction orthogonal to a transport direction of the medium on the medium supporting unit, a notifying step for notifying the notifying unit of a result based on an image imaged by the imaging unit, and an adjusting step for adjusting the shaft adjusting mechanism.

In the method for adjusting the printing apparatus described above, it is preferable that the notifying step is configured to perform notification about the image of the measurement pattern imaged by the imaging unit.

In the method for adjusting the printing apparatus described above, it is preferable that the method includes a determining step for determining necessity of position adjustment of the winding shaft, and the notifying step is configured to perform notification about the determination result of the determining step.

In the method for adjusting the printing apparatus described above, it is preferable that the imaging step is repeatedly executed, and the notifying step is configured to notify, when it is determined that the position adjustment of the winding shaft is unnecessary in the determining step.

The method for adjusting the printing apparatus described above is preferable that, in the imaging step, the imaging unit images the two locations by being moved in a direction orthogonal to the transport direction.

The method for adjusting the printing apparatus described above is preferable that, in the jig installing step, a substance that applies tension to the jig is coupled to the other end of the jig.

The printing apparatus according to the present disclosure includes: a head configured to discharge a droplet to a medium, a medium supporting unit configured to support the medium facing the head, an imaging unit configured to capture, facing the medium support unit, an image, a winding shaft for winding the medium, a shaft adjusting mechanism configured to adjust the position of the winding shaft, and a notifying unit configured to perform notification about information of a device, and a controller a controller configured to image, by the imaging unit, a measurement pattern of a jig locked to the medium supporting unit along a transporting path at both ends in a width direction of the medium with one end of the jig being attached to the winding shaft, the pattern being imaged at two locations different from each other in a direction orthogonal to the transporting direction of the medium on the medium supporting unit, determine necessity of position adjustment of the winding shaft based on the image imaged by the imaging unit, and perform notification, at the notifying unit, about the determination result.

DESCRIPTION OF EXEMPLARY EMBODIMENTS

Exemplary embodiments of the present disclosure will be described below with reference to the accompanying drawings. The following is an exemplary embodiment of the disclosure and is not intended to limit the disclosure. Note that, in each of the figures below, to illustrate each of members and the like in a recognizable size, each of the members and the like is illustrated to a scale different from an actual scale. Further, in the coordinates appended to the figures, both directions along the Z-axis is set to be vertical direction and the arrow direction is set to be "up", both directions along the X-axis is set to be horizontal direction and the arrow direction is set to be "left", both directions along the Y-axis is set to be longitudinal direction and the arrow direction is set to be "front", the X-Y plane is set to be the "horizontal plane". In addition, both directions along the X-axis correspond to a main scanning direction, and the Y-axis corresponds to the transport direction.

1. Embodiments

The printing apparatus described in the present embodiment is, for example, an ink jet printer. In the present embodiment, a large format printer (LFP), which is in a roll-to-roll manner, and which handles a relatively large medium will be used as an example of the configuration of the printing apparatus.

Figure 1:
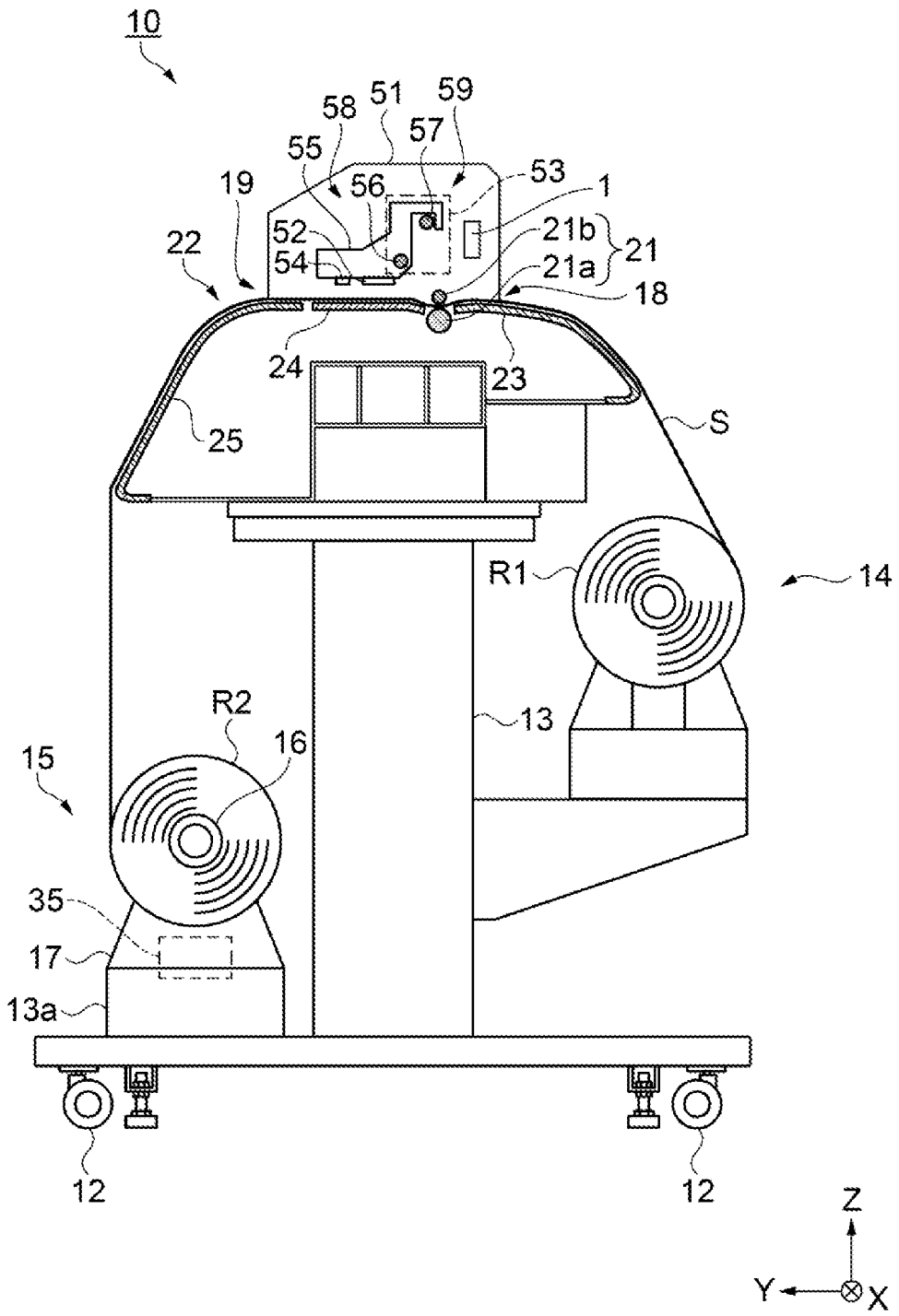
FIG. 1 is a cross-sectional view illustrating a configuration at a time of printing of a printing apparatus according to an embodiment.

FIG. 1 is a cross-sectional view illustrating a configuration at a time of printing of a printing apparatus according to the embodiment. A configuration of the printing apparatus 10 will be described with reference to FIG. 1.

As illustrated in FIG. 1, the printing apparatus 10 is configured to include a transporting roller pair 21 configured to transport a medium S in a transport direction, a medium supply unit 14 for supplying the medium S of a roll body R1 to the transporting roller pair 21, a printing unit 58 configured to perform printing on the transported medium S, and a medium winding unit 15 configured to wind the printed medium S into a roll-shape. The printing unit 58 is disposed in a housing unit 51 with a long substantially rectangular parallelepiped form in the X-axis. These units are each supported by a frame 13 to which a wheel 12 is attached at a lower end. In addition, the positional relationship along the transport direction of the medium S is also referred to as "upstream side" or "downstream side".

The medium supply unit 14 is disposed in behind the housing unit 51. The roll body R1 of an unused medium S is held in the medium supply unit 14 in a cylindrical wound-up state. Note that, in the medium supply unit 14, a plurality of sizes of roll bodies R1 having different widths and number of windings along the X-axis of the medium S are exchangeably loaded. In addition, regardless of the size of the roll body R1, the roll body R1 is loaded into the medium supply unit 14 in a state of being close to right end. Then, by rotating the medium supply unit 14 loaded with the roll body R1 in the counterclockwise direction in FIG. 1, the medium S is unwound from the roll medium R1 and is fed to the printing unit 58.

The medium winding unit 15 is disposed in front of the housing unit 51. At the medium winding unit 15, the medium S printed at the printing unit 58 is wound into a cylinder shape to form a roll body R2. The medium winding unit 15 includes a pair of holders 17 that sandwich a winding shaft 16 for winding up the medium S to form the roll body R2. One holder 17 is provided with a winding motor (not illustrated) that supplies rotary power to the winding shaft 16. By that the winding motor is driven and the winding shaft 16 rotates, the medium S is wound around the winding shaft 16 to form the roll body R2.

A pair of holders 17 are fixed on a base frame 13*a* that extends along the X-axis. Each holder 17 is provided with a shaft adjusting mechanism 35 for adjusting the position of the winding shaft 16 along the Z-axis. The shaft adjustment mechanism 35 can be configured with a height adjusting bolt (not illustrated) that can adjust the height of the holder 17 with respect to the base frame 13*a* while maintaining the connection between the base frame 13*a* and the holder 17. By the shaft adjustment mechanism 35 disposed on each of the left and right holders 17, it is possible to individually change the height of one end and the other end of the winding shaft 16. Note that the winding shaft 16 is configured to include a tube in which the medium S is directly wound, a flange attached to both sides of the roll body R2, a spindle coupled to the winding motor, and transmitting a rotational force to a paper tube. Further, the medium winding unit 15 may be configured to include a tension roller configured to press a back surface of the medium S hanging down under its own weight and applies tension to the medium S that is wound on the winding shaft 16.

The printing apparatus 10 includes an upstream side guiding unit 23, a platen 24 as a medium supporting unit, and a downstream side guiding unit 25 that constitute a part of the transporting path 22 of the medium S transported by the transporting roller pair 21. The upstream side guiding unit 23 is disposed on the upstream side of the transporting roller pair 21 and is configured to guide the medium S supplied from the medium supply unit 14 to the transporting roller pair 21. The platen 24 is disposed at a position facing the printing unit 58 and is configured to support the medium S facing a head 52. The downstream side guiding unit 25 is disposed on the downstream side of the platen 24 and is configured to guide the printed medium S from the platen 24 to the medium winding unit 15.

The transporting roller pair 21 extends in a direction intersecting the transport direction of the medium S, and is disposed between the platen 24 and the upstream side guiding unit 23. The transporting roller pair 21 includes a transport driving roller 21*a* for rotational driving disposed on a lower side of the transporting path 22 and a transport driven roller 21*b* driven by the rotation of the transport driving roller 21*a* disposed on an upper side of the transport driving roller 21*a*. The transport driven roller 21*b* is configured to be movable so as to be separated from and pressed against the transport driving roller 21*a*. In a state that the transport driving roller 21*a* and the transport driven roller 21*b* are pressed against each other, the transporting roller pair 21 sandwiches the medium S and feeds the medium S to the printing unit 58. A transporting motor (not illustrated) is disposed inside the housing unit 51 as a power source for outputting rotary power to the transport driving roller 21*a*. When the transporting motor is driven and the transport driving roller 21*a* is driven in rotation, the medium S sandwiched between the transport driven roller 21*b* and the transport driving roller 21*a* is transported in the transport direction.

An operation panel 62 (see FIG. 3) is disposed at the upper right part of the housing unit 51. The operation panel 62 includes a display unit 64 on which a printing condition setting screen and the like are displayed and an operating unit 63 that is operated when inputting a printing condition or giving various instructions. The display unit 64 also functions as a notifying unit 61 (see FIG. 2) described below. A container mounting unit 66 (see FIG. 3) that can mount a liquid accommodating container that can contain a liquid is disposed on the lower right part of the housing unit 51. A plurality of liquid accommodating containers, which are corresponding to the type and color of the liquid, are mounted on the container mounting unit 66. Furthermore, a controller 1 configured to control the operation of each unit of the printing apparatus 10 is disposed inside the housing unit 51.

The printing unit 58 is disposed inside the housing unit 51. On the rear surface of the housing unit 51, at a position of the upper side of the upstream side guiding unit 23, a supplying port 18 for supplying the medium S to the printing unit 58 is formed. Furthermore, on the front surface of the housing unit 51, at a position of the upper side of the downstream side guiding unit 25, a discharging port 19 for discharging the medium S printed by the printing unit 58 is formed.

The printing unit 58 is disposed above where the platen 24 is disposed. The printing unit 58 includes the head 52 configured to discharge a droplet with respect to the medium S fed from the medium supply unit 14 and transported to the platen 24 along the upstream side guiding unit 23, a carriage 55 on which the head 52 is mounted, a head moving unit 59 configured to move the carriage 55 in a main scanning direction that intersects with the transport direction.

The head moving unit 59 moves the carriage 55 in the main scanning direction. The carriage 55 is supported by guide rails 56, 57 disposed along the X-axis, and is configured to be movable reciprocally in both directions along the X-axis by the head moving unit 59. As the mechanism of the head moving unit 59, for example, a mechanism including a combination of a ball screw and a ball nut, a linear guide mechanism, or the like may be employed. Further, the head moving unit 59 is provided with a motor (not illustrated) as a power source to move the carriage 55 along the X-axis direction. When the motor is driven by the control of the controller 1, the head 52 moves reciprocally in both directions along the X-axis with the carriage 55.

On both end portions of the guide rail 56, 57, an adjustment mechanism 53 is disposed, which changes the position along the Z-axis of the head 52 for adjusting the distance between the head 52 and the platen 24. Further, on the lower part of the carriage 55, an imaging unit 54 that images on the platen 24 is disposed at a position of downstream side than the head 52 in the transport direction. The imaging unit 54 includes a lens and an imaging element (not illustrated) configured to convert light incident from the lens into an electrical signal. Printing is performed by the head 52 discharging the liquid supplied from the liquid accommodating container with respect to the medium S transported along the transporting path 22 as droplets. The printed medium S is guided diagonally downward along the downstream side guiding unit 25 and is wound by the medium winding unit 15.

Note that in the present embodiment, as the head 52, the printing apparatus 10 of a serial head configured to be mounted on a reciprocating carriage 55 and discharge liquid while moving in the width direction of the medium S is illustrated, but it also may be a printing apparatus including a line head extending in the width direction of the medium S and arranged in fixed manner, and two imaging units 54 disposed in a fixed manner above a mark 24*a* and a mark 24*b* described later. Furthermore, the printing apparatus 10 may have a configuration in which a heater for rapidly drying and fixing the liquid droplet on the medium S by heating the medium S is built in, or a configuration provided with a drying furnace.

Figure 2:
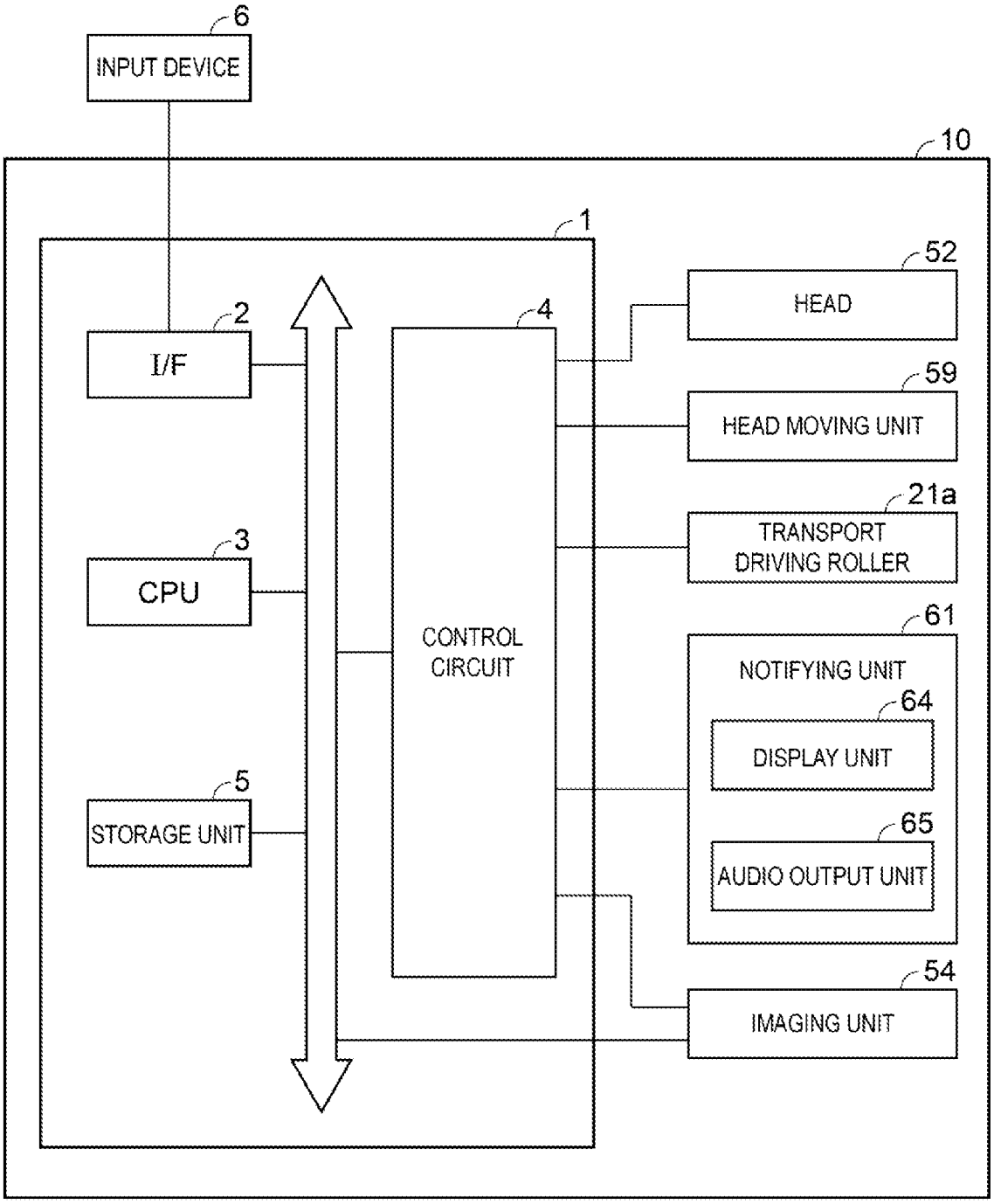
FIG. 2 is a block diagram illustrating an electrical connection of the printing apparatus.

Next, an electrical configuration of the printing apparatus 10 will be described with reference to FIG. 2. FIG. 2 is a block diagram illustrating an electrical connection of the printing apparatus.

The printing apparatus 10 is configured to print images, characters, and the like on the medium S based on the print data input to an input device 6. The input device 6 may be a personal computer or the like, and may have a configuration in which it is disposed in the same housing unit 51 as the printing apparatus 10. The input device 6 is configured to perform control of jobs in which the printing is performed by the printing apparatus 10 and controls the printing apparatus 10 in coordination with the controller 1 of the printing apparatus 10. Software operated by the input device 6 includes general image processing application software for handling print data and printer driver software for generating print data to make the printing apparatus 10 perform printing.

The printing apparatus 10 includes the controller 1 configured to perform control of the units included in the printing apparatus 10. The controller 1 is configured to include an interface unit (I/F) 2, a central processing unit (CPU) 3, a control circuit 4, a storage unit 5, and the like. The interface unit 2, the storage unit 5, and the control circuit 4 are electrically coupled to the CPU 3 via a bus. The interface unit 2 is configured to perform transmitting/receiving data between the input device 6 configured to handle input signals or images and the controller 1. For example, the interface unit 2 receives print data and the like generated by the input device 6.

The CPU 3 is an arithmetic processing device for performing various input signal processings, and an overall control of the printer 10 in accordance with programs stored in the storage unit 5 and print data received from the input device 6.

The storage unit 5, which serves as a storage medium that ensures an area for storing the programs, a work area, and the like of the CPU 3, includes a storage device such as a Random Access Memory (RAM), an Electrically Erasable Programmable Read Only Memory (EEPROM), or the like.

The control circuit 4 is electrically coupled to the head 52, the head moving unit 59, the transport driving roller 21*a*, and the like. The control circuit 4 is configured to generate control signals for controlling the head 52, the head moving unit 59, the transporting roller pair 21, and the like based on the print data and a calculation result of the CPU 3.

Further, the control circuit 4 is electrically coupled to the imaging unit 54. The imaging unit 54 is electrically coupled to the CPU 3 via a bus. The control circuit 4 generates a control signal for controlling the imaging unit 54. The imaging unit 54 images graduations 32 (see FIG. 5) on the platen 24 described later, based on the control signal generated by the control circuit 4, converts the imaged image to an electrical signal, and transmits the image to the CPU 3.

Further, the control circuit 4 is electrically coupled to the notifying unit 61. The notifying unit 61 is configured to perform notification about information of the device, and is configured to include a display unit 64 that displays images and characters, and an audio output unit 65 that outputs sound. The control circuit 4 generates control signals for notifying the notifying unit 61 of a result based on the image imaged by the imaging unit 54.

The controller 1, based on the control signals output from the control circuit 4, by performing a main scan in which the carriage 55 is moved along the X-axis as the main scanning direction, while discharging droplets from the nozzles, forms a raster line of dots aligned along the X-axis Additionally, the controller 1 performs sub scanning by moving the medium S along the Y-axis as the transport direction, based on a control signal output from the control circuit 4. By alternately performing main scanning and sub scanning by the controller 1, a desired image based on the print data is printed on the medium S.

Figure 3:
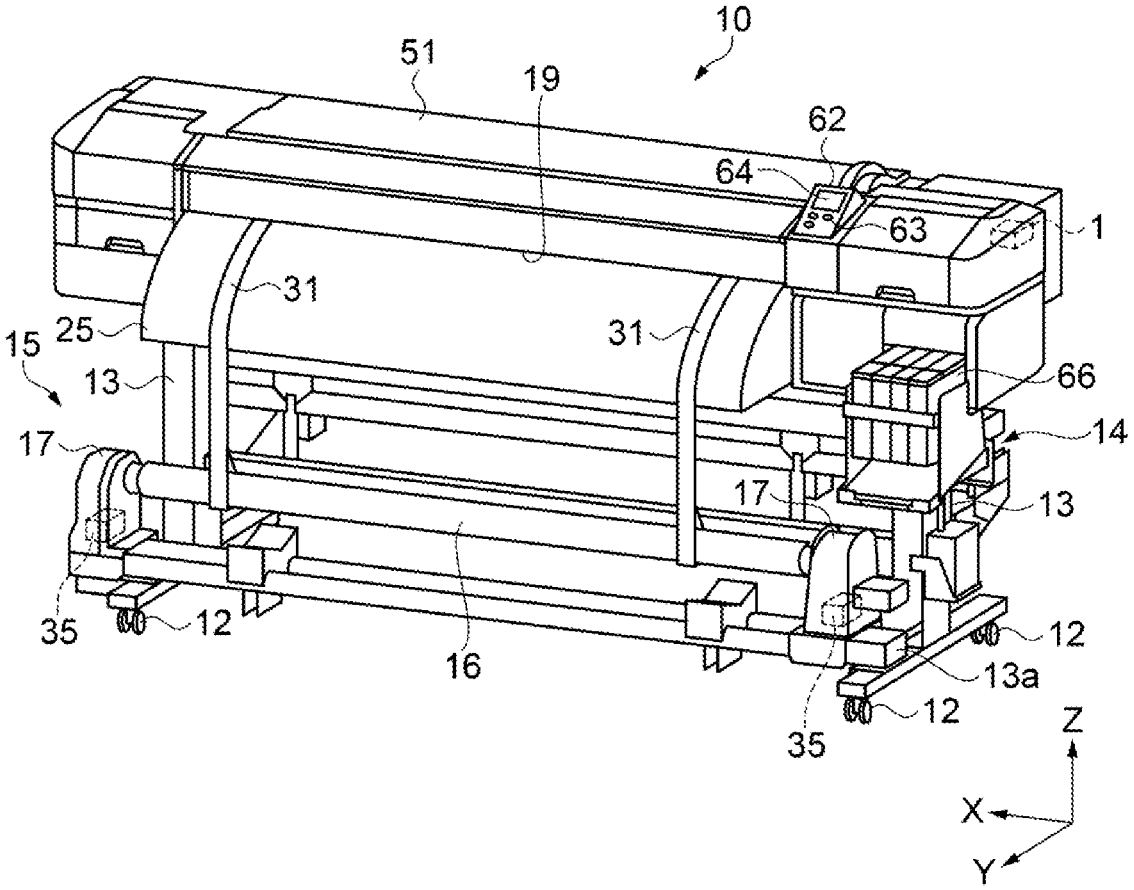
FIG. 3 is a perspective view illustrating a schematic configuration at a time of adjusting of the printing apparatus.
Figure 4:
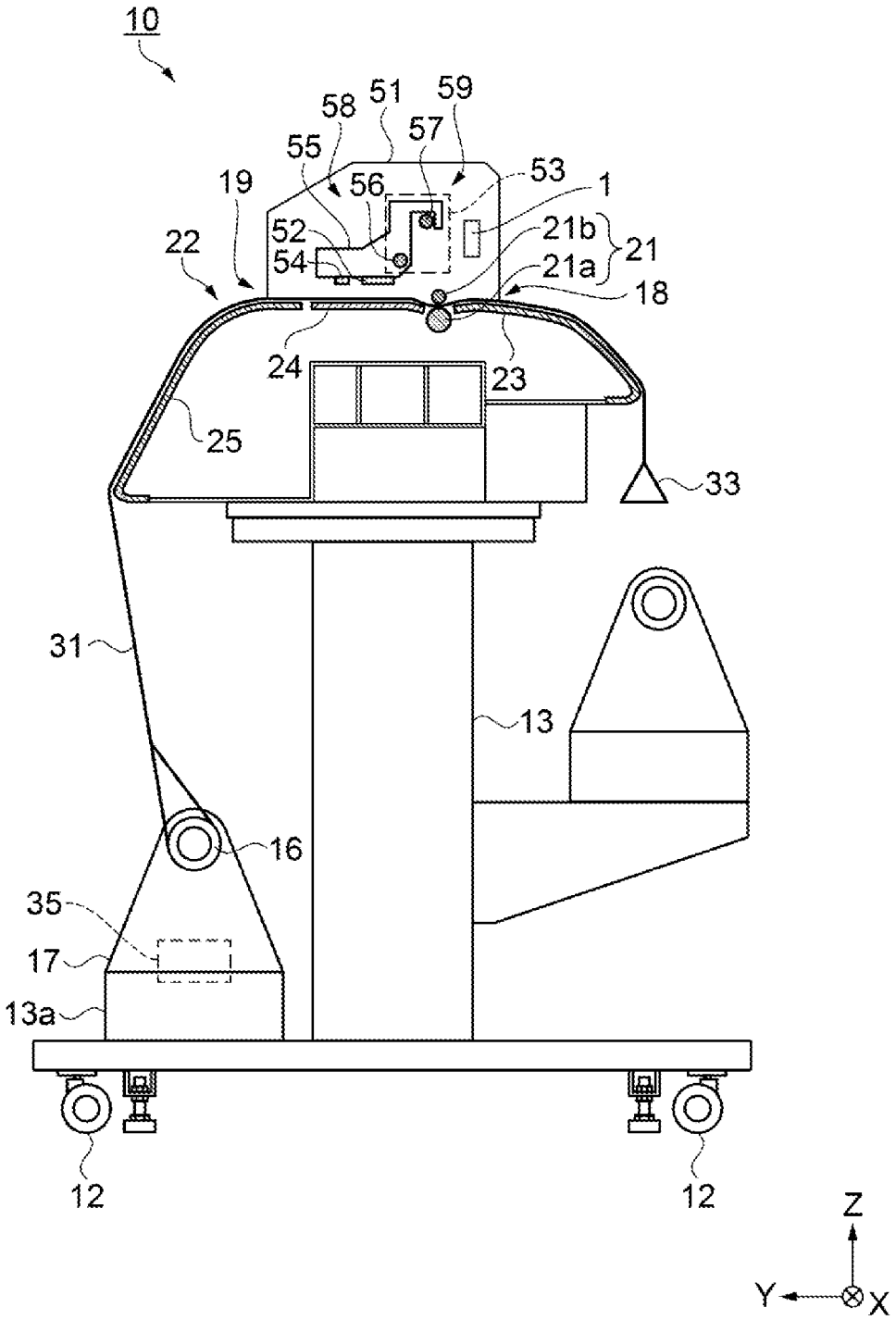
FIG. 4 is a cross-sectional view illustrating a configuration at the time of adjusting of the printing apparatus.
Figure 5:
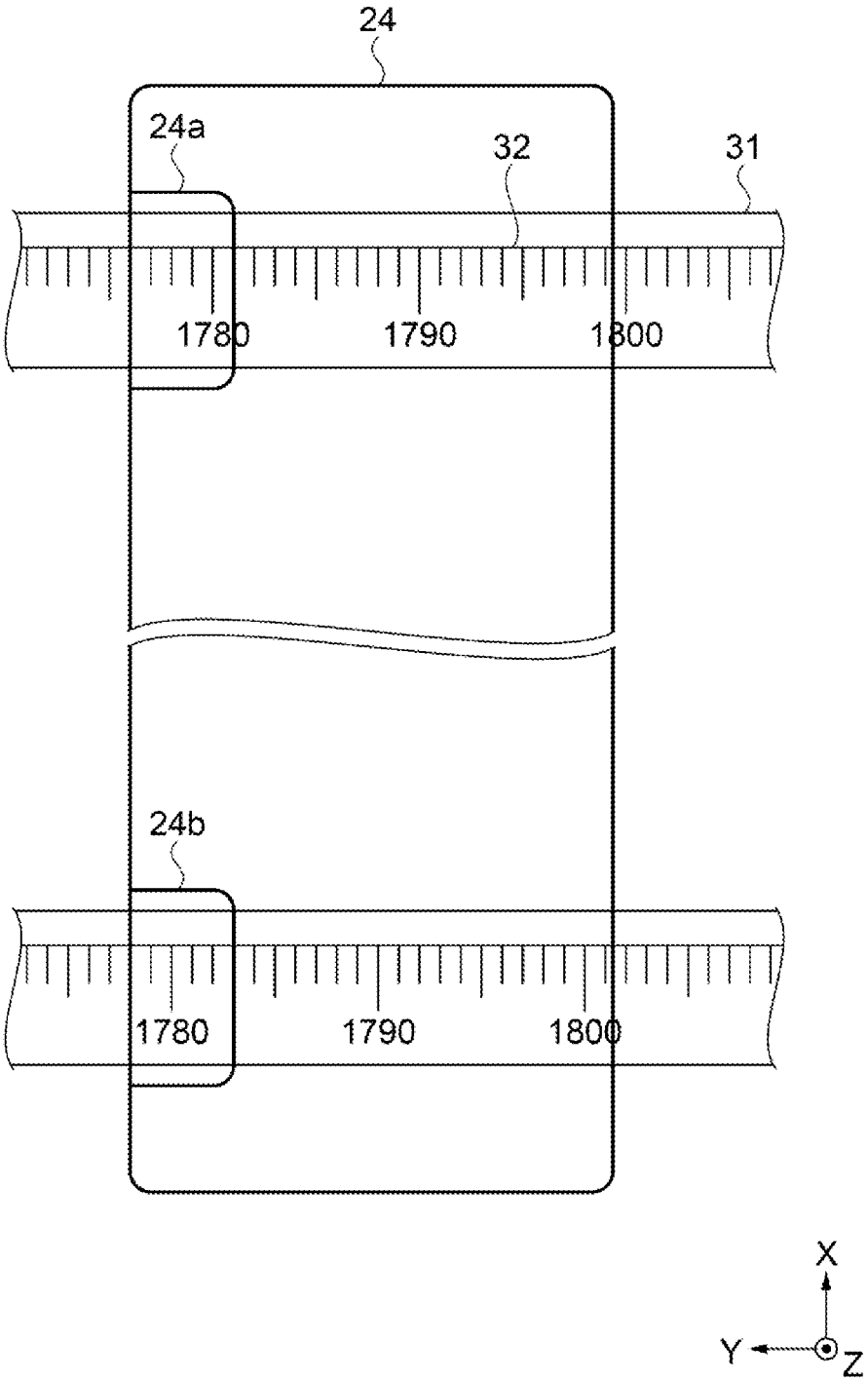
FIG. 5 is an enlarged view illustrating a jig locked to a platen.
Figure 6:
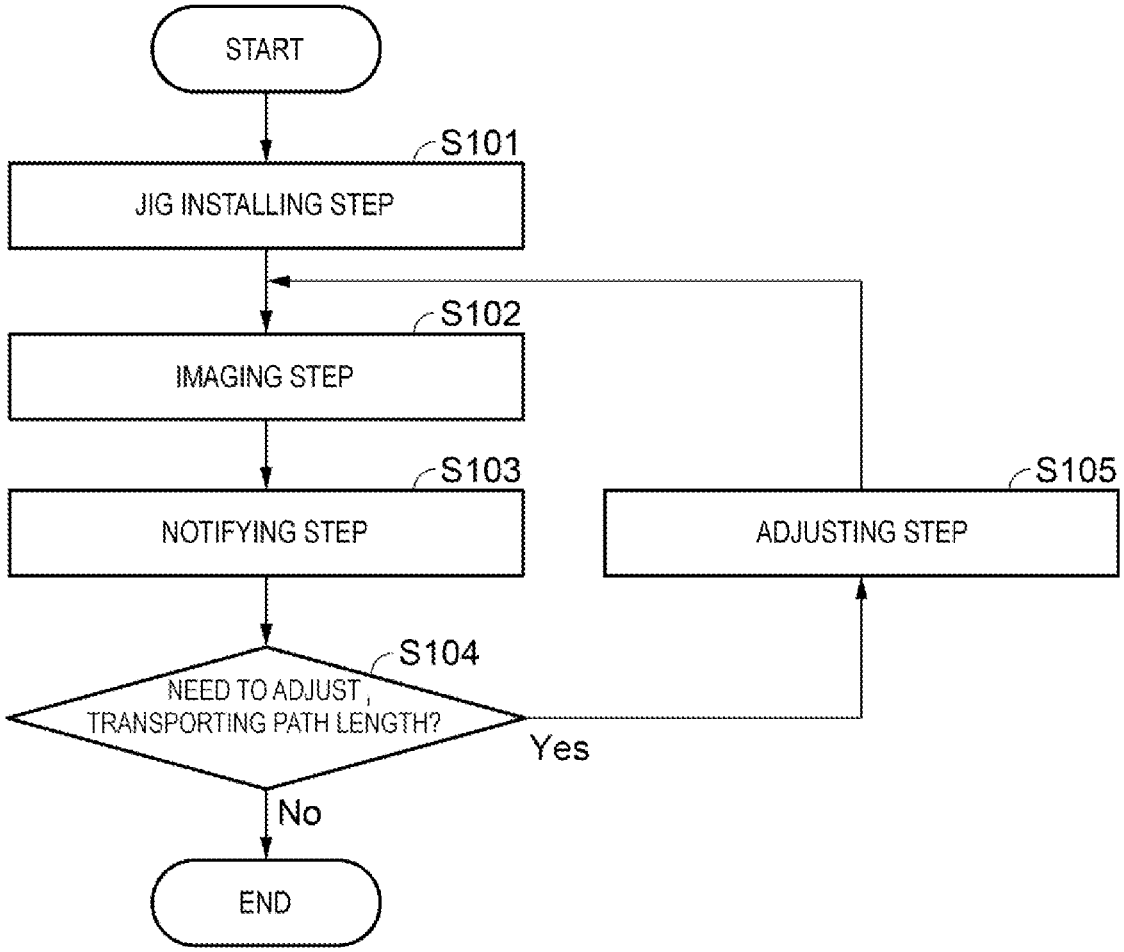
FIG. 6 is a flowchart describing a method for adjusting a transporting path length.

Next, a method for adjusting the transporting path length will be described with reference to FIGS. 3 to 6. FIG. 3 is a perspective view illustrating a schematic configuration at the time of adjustment of the printing apparatus. FIG. 4 is a cross-sectional view illustrating a configuration at the time of adjustment of the printing apparatus. FIG. 5 is an enlarged view illustrating a jig locked to the platen. FIG. 6 is a flowchart describing a method for adjusting a transporting path length. The adjustment of the transporting path length refers to matching the length of the medium transporting path from the platen 24 to the winding shaft 16 along the right end in the width direction of the medium S, and the length of the medium transporting path along the left end in the width direction of the medium S. The adjustment of the transporting path length can be adjusted by a shaft adjusting mechanism 35 disposed on each of the left and right holders 17. In the following description, the length of the medium transporting path along the right end of the medium S is referred to as the "right transporting path length", and the length of the medium transporting path along the left end of the medium S is referred to as the "left transporting path length".

Step S101 is a jig installing step for installing the jig 31 for adjusting the transporting path length in the printing apparatus 10. The jig 31 is strip-shaped, and a measurement pattern is formed on the strip-shaped jig 31. In the present embodiment, graduations 32 are formed as a measurement pattern. A ring is formed on one end of the jig 31. The operator attaches one end of the jig 31 to the winding shaft 16 by passing the winding shaft 16 through the ring, and passes the other end of the jig 31 from the discharging port 19 to the supplying port 18. The jig 31 is locked to the platen 24 along a transporting path at both ends in the width direction of the medium S. The substance 33 is coupled to the other end of the jig 31 hanging downward from the upstream side guiding part 23. As a result, tension is applied to the jig 31. The material of the substance 33 is not particularly limited. In the present embodiment, a solid rubber having a mass of approximately 200 g is coupled. The jig 31 has been described that the graduations 32 are formed as a measurement pattern, but the measurement pattern can be any pattern as long as a difference in the length of the left and right transporting path lengths may be obtained.

Rectangular marks 24*a*, 24*b* are formed on the platen 24, which illustrate a position at which the jig 31 is installed and a position for reading the graduations 32. Two sides of the rectangular mark 24*a*, 24*b* along the Y-axis are positions at which the jig 31 is installed, and one side along the X-axis is a position for reading the graduations 32. The jig 31 disposed on the mark 24*a* measures the left transporting path length, and the jig 31 disposed on the mark 24*b* measures the right transporting path length. The material of the jig 31 is not particularly limited as long as the material is provided with flexibility and non-elastic properties.

Step S102 is an imaging step for imaging the graduations 32. The imaging unit 54 images the graduations 32 at two locations different from each other in an X-axis orthogonal to the Y-axis, which is the transport direction of the medium S on the platen 24. In the present embodiment, one imaging unit 54 is moved along the X-axis with the carriage 55, and imaging the jig 31 on the mark 24*a* of the platen 24 and the jig 31 on the mark 24*b* of the platen 24. Note that the two imaging units 54 disposed in a fixed manner above the mark 24*a* and the mark 24*b* may be configured to image each of the jigs 31. In this case, the two locations can be simultaneously imaged, so the adjustment time of the transporting path length can be shortened.

Step S103 is a notifying step for notifying a result based on an image imaged by the imaging unit 54. The controller 1 is configured to generate an image in which images of the graduations 32 imaged by the mark 24*a* and the mark 24*b* are aligned by the image capturing unit 54, and notifies the display unit 64. Note that the controller 1 may be configured to calculate the difference between the left transporting path length and the right transporting path length from the images of the graduations 32 taken by the mark 24*a* and the mark 24*b*, and notify the result to the display unit 64.

Step S104 is a determining step in which the operator determines necessity of adjustment of the transporting path length. For example, the operator checks the notifying content of step S103, and when the difference between the left transporting path length and the right transporting path length exceeds ±0.5 mm, the operator determines that the adjustment of the transporting path length is required (step S104: Yes), and proceeds to step S105, repeating step S102 to step S104. When the difference between the left transporting path length and the right transporting path length is ±0.5 mm or less, the operator determines that the adjustment of transporting path length is not required (step S104: No) and ends the present flow.

Step S105 is an adjusting step for adjusting the shaft adjustment mechanism 35 to adjust the transporting path length. The operator checks the results notified to the display unit 64, and operates at least one of the shaft adjustment mechanisms 35 disposed on each of the left and right holders 17 to adjust the height of the winding shaft 16, and adjusts the difference between the left transporting path length and the right transporting path length to ±0.5 mm or less. As a result, it is possible to suppress the occurrence of unwinding, wrinkles, and the like of the medium S wound on the winding shaft 16.

As described above, the printing apparatus 10 according to the present embodiment can obtain the following advantages.

The method for adjusting the printing apparatus 10 notifies the result based on the image that the jig 31 on which the graduations 32 are formed is imaged at two locations on the mark 24*a* and the mark 24*b* marked on the platen 24. The adjustment of the transporting path length is adjusted by the shaft adjustment mechanism 35 disposed on each of the left and right holders 17 based on the notification result. After adjusting the transporting path length, an imaging process and a notifying step are performed, and the adjustment results of the transporting path are displayed on the display unit 64. The operator can confirm the adjustment result of the transporting path length on the display unit 64, thus variations in the adjustment results of the transporting path length generated for each operator can be suppressed.

The imaged graduation 32 of the imaging unit 54 is displayed on the display unit 64. Thus, the operator can easily confirm the adjustment result of the transporting path length on the image of the graduation 32.

The imaging unit 54 is disposed on the carriage 55 and moves with the carriage 55 in a direction orthogonal to the transport direction. As a result, two different locations can be imaged by one imaging unit 54, and therefore, costs for disposing the imaging unit 54 can be suppressed.

A substance 33 for applying tension to the jig 31 is coupled to the other end of the jig 31 hanging downward from the upstream side guiding part 23. Thus it is possible to suitably adjust the transporting path length.

Note that, the present disclosure is not limited to the embodiments described above, and various modifications and improvements can be added to the above-described embodiments. Modifications are described below.

2. Modifications

Figure 7:
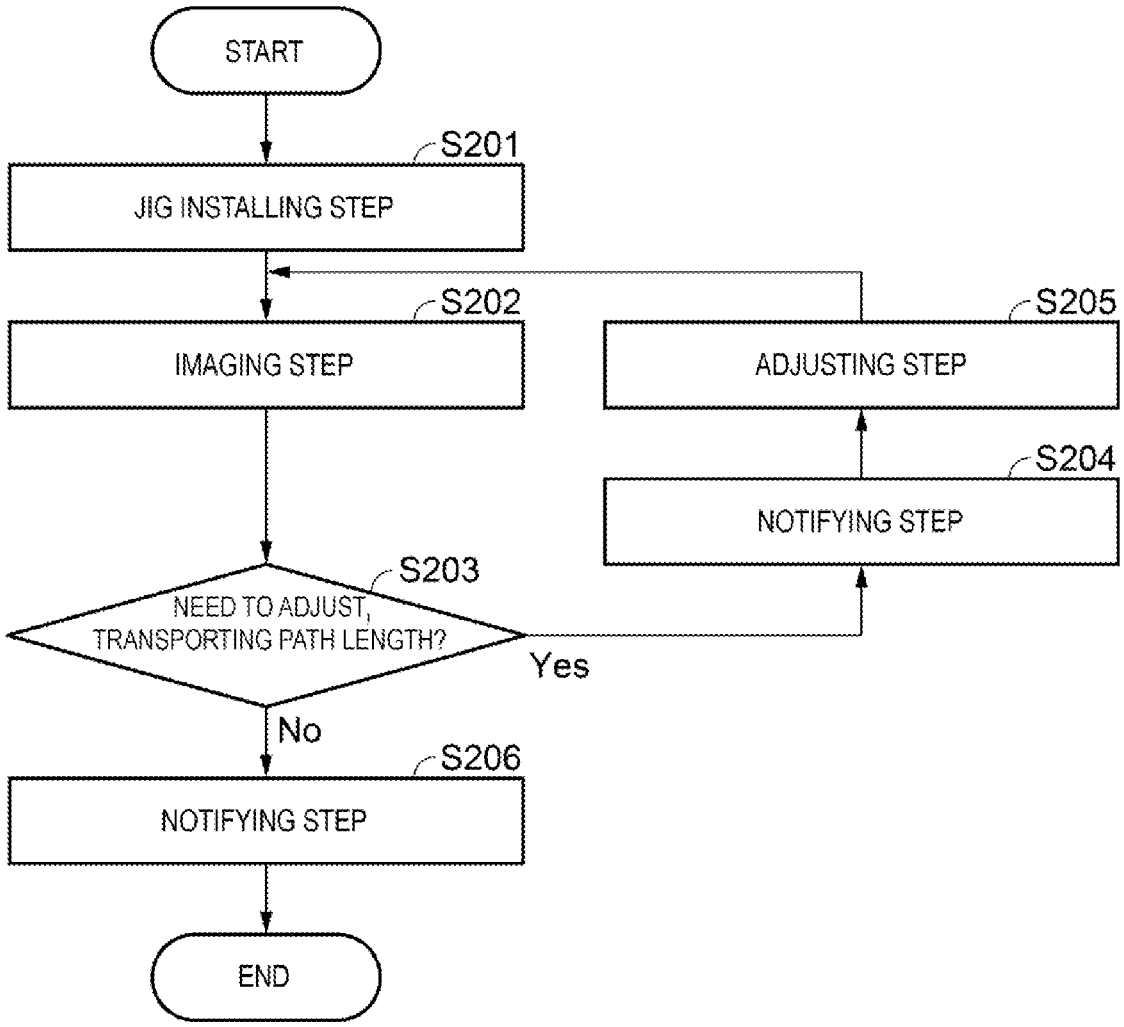
FIG. 7 is a flowchart describing a method for adjusting a transporting path length according to a modification.

FIG. 7 is a flowchart describing a method for adjusting a transporting path length according to a modification. Note that, step S201 is the same as step S101 described in the embodiment, step S202 is the same as step S102 described in the embodiment, step S205 is the same as step S105 described in the embodiment, thus the description thereof will be omitted. Furthermore, the configuration of the printing apparatus according to the modification is the same as the printing apparatus 10 described in the embodiment, and thus description thereof will be omitted.

The CPU 3 of the controller 1 determines the necessity of adjustment of the transporting path length based on the image imaged at two locations on the mark 24*a* and the mark 24*b* marked on the platen 24.

Step S203 is a determining step in which the controller 1 determines the necessity of position adjustment of the winding shaft 16, that is, the necessity of adjustment of the transporting path length. The controller 1 calculates a difference between the left transporting path length and the right transporting path length from the image of each of the graduations 32 imaged at the mark 24*a* and the mark 24*b*. For example, when the difference between the left transporting path length and the right transporting path length exceeds ±0.5 mm, the controller 1 determines that the adjustment of the transporting path length is necessary (step S203: Yes), and proceeds to step S204, S205, and repeats steps S202 and S203. When the difference between the left transporting path length and the right transporting path length is ±0.5 mm or less, the controller 1 determines that the adjustment of the transporting path length is unnecessary (step S203: No) and proceeds to step S206.

Step S204 is a notifying step for notifying a determination result when adjustment of the transporting path length is determined to be necessary. When the controller 1 determines that the adjustment of the transporting path length is necessary in step S203, for example, the controller 1 notifies the display unit 64 as "adjustment value: right path +0.8 mm". The operator can recognize that the adjustment of the transporting path length is necessary and the adjustment value of the transporting path.

Step S205 is an adjustment step for adjusting the transporting path length. The operator operates at least one of the shaft adjustment mechanisms 35 disposed on each of the left and right holders 17 based on the results notify to the display unit 64 to perform the height adjustment of the winding shaft 16. The flow of the present modification returns to the imaging step of step S202 without waiting for the completion of the adjustment of the transporting path length. The imaging step of step S202, the notifying step of step S204, and the adjusting step of step S205 are repeated until the adjustment of the transporting path length is determined to be unnecessary in the determining step of step S203.

Step S206 is a notifying step for notifying a determination result when the adjustment of the transporting path length is determined to be unnecessary. When the controller 1 determines that the adjustment of the transporting path length is unnecessary in step S203, the controller 1 outputs, for example, the voice indicating that the adjustment of the transporting path length was completed from the audio output unit 65. That is, the adjusting step of step S205 continues until the operator recognizes a notifying from the notifying step of step S206. For example, the controller 1 displays "completion of adjustment" in the display unit 64, and terminates the flow.

As described above, the printing apparatus 10 according to the present modification can obtain the following advantages.

The printing apparatus 10 includes a controller 1 configured to determine the position adjustment of the winding shaft 16, that is, the necessity of the adjustment of the transporting path length, and notifies the determination result to the display unit 64. As a result, variations in the adjustment results of the transporting path length occurring for each operator can be suppressed.

The method for adjusting the printing apparatus 10 includes a determining step in which the controller 1 determines the necessity of the adjustment of the transporting path length, and a notifying step for notifying the determination result of the determining step, thus, the operator can easily recognize whether the adjustment of the transporting path length was correctly made.

The method includes a notifying step for notifying a determination result in when the adjustment of the transporting path length is determined to be unnecessary. Thus, the operator may continue adjusting the path length of the transporting path until recognizing that the notifying by the voice determined that the adjustment is unnecessary. The operator can complete the adjustment of the transporting path length without each confirmation of the content notified to the display unit 64.

Contents derived from the Embodiments will be described below.

A method for adjusting a printing apparatus according to the present disclosure, which the printing apparatus includes: a head configured to discharge a droplet to a medium, a medium supporting unit configured to support the medium facing the head, an imaging unit configured to capture, facing the medium support unit, an image, a winding shaft for winding the medium, a shaft adjusting mechanism configured to adjust the position of the winding shaft, and a notifying unit configured to perform notification about information of a device, comprising: a jig installing step for attaching one end of a strip-shaped jig, on which a measurement pattern is formed, to the winding shaft, and locking the jig to the medium supporting unit, along a transporting path at both ends in a width direction of the medium, an imaging step for imaging the measurement pattern by the imaging unit at two locations different from each other, in a direction orthogonal to a transport direction of the medium on the medium supporting unit, a notifying step for notifying the notifying unit of a result based on an image imaged by the imaging unit, and an adjusting step for adjusting the shaft adjusting mechanism.

According to this method, results based on images imaged at two locations on the medium supporting unit of the jig, on which the measurement pattern formed, are notified. The transporting path length of the medium is adjusted by a shaft adjusting mechanism of the winding shaft. By imaging the jig after adjusting the transporting path length, the adjustment result can be informed. The operator can confirm the adjustment result of the transporting path length in the notifying unit, thus, variations in the adjustment result of the transporting path length generated for each operator can be suppressed.

In the method for adjusting the printing apparatus described above, it is preferable that the notifying step is configured to perform notification about the image of the measurement pattern imaged by the imaging unit.

According to this method, the operator can easily confirm the adjustment result of the transporting path length in the image of the measurement pattern.

In the method for adjusting the printing apparatus described above, it is preferable that the method includes a determining step for determining necessity of position adjustment of the winding shaft, and the notifying step is configured to perform notification about the determination result of the determining step.

According to this method, the determining step determines the necessity of the position adjustment of the winding shaft, the operator can easily recognize whether the adjustment of the transporting path length was correctly made.

In the method for adjusting the printing apparatus described above, it is preferable that the imaging step is repeatedly executed, and the notifying step is configured to notify, when it is determined that the position adjustment of the winding shaft is unnecessary in the determining step.

According to this method, it is possible to continue adjusting the position of the winding shaft until the notifying unit notifies that the position adjustment of the winding shaft is unnecessary.

The method for adjusting the printing apparatus described above is preferable that, in the imaging step, the imaging unit images the two locations by being moved in a direction orthogonal to the transport direction.

According to this method, two locations can be imaged by one imaging unit, and thus cost for disposing the imaging unit can be suppressed.

The method for adjusting the printing apparatus described above is preferable that, in the jig installing step, a substance that applies tension to the jig is coupled to the other end of the jig.

According to this method, by applying tension to the jig, it is possible to suitably adjust the transporting path length.

The printing apparatus according to the present disclosure includes: a head configured to discharge a droplet to a medium, a medium supporting unit configured to support the medium facing the head, an imaging unit configured to capture, facing the medium support unit, an image, a winding shaft for winding the medium, a shaft adjusting mechanism configured to adjust the position of the winding shaft, and a notifying unit configured to perform notification about information of a device, and a controller a controller configured to image, by the imaging unit, a measurement pattern of a jig locked to the medium supporting unit along a transporting path at both ends in a width direction of the medium with one end of the jig being attached to the winding shaft, the pattern being imaged at two locations different from each other in a direction orthogonal to the transporting direction of the medium on the medium supporting unit, determine necessity of position adjustment of the winding shaft based on the image imaged by the imaging unit, and perform notification, at the notifying unit, about the determination result.

According to this configuration, the controller determines the necessity of the position adjustment of the winding shaft based on the image imaged at two locations on the medium support unit of the formed jig of the measuring pattern. The transporting path length of the medium is adjusted by a shaft adjusting mechanism of the winding shaft. By capturing the jig after adjusting the transporting path length, it is possible to determine the necessity of that the transporting path length is adjusted again, that is, it is possible to determine whether the transporting path length has been adjusted correctly, as a result, variations in the adjustment results of the transporting path length occurring for each operator can be suppressed.

What is claimed is:

1. A method for adjusting a printing apparatus including a head configured to discharge a droplet to a medium; a medium supporting unit configured to support the medium facing the head; an imaging unit configured to capture, facing the medium support unit, an image; a winding shaft for winding the medium; a shaft adjusting mechanism configured to adjust a position of the winding shaft; and a notifying unit configured to perform notification about information of a device, the method comprising:

a jig installing step for attaching one end of a strip-shaped jig, at which a measurement pattern is formed, to the winding shaft to lock the jig to the medium supporting unit, along a transporting path at both ends in a width direction of the medium;

an imaging step for imaging the measurement pattern by the imaging unit at two locations different from each other in a direction orthogonal to a transport direction of the medium on the medium supporting unit, a notifying step for performing notification, at the notifying unit, about a result based on an image captured by the imaging unit, and an adjusting step for adjusting the shaft adjusting mechanism.

2. The method for adjusting the printing apparatus according to claim 1, wherein in the notifying step, notification is performed about an image of the measurement pattern imaged by the imaging unit.

3. The method for adjusting the printing apparatus according to claim 1, comprising:

a determining step for determining necessity of position adjustment of the winding shaft, wherein in the notifying step, notification is performed about the determination result of the determining step.

4. The method for adjusting the printing apparatus according to claim 3, wherein the imaging step is repeatedly executed, and notification is performed in the notifying step, when it is determined that the position adjustment of the winding shaft is unnecessary in the determining step.

5. The method for adjusting the printing apparatus according to claim 1, wherein in the imaging step, the imaging unit images the two locations by being moved in a direction orthogonal to the transport direction.

6. The method for adjusting the printing apparatus according to claim 1, wherein in the jig installing step, a substance that applies tension to the jig is coupled to the other end of the jig.

7. A printing apparatus comprising:

a head configured to discharge a droplet to a medium;

a medium supporting unit configured to support the medium facing the head;

an imaging unit configured to capture, facing the medium support unit, an image;

a winding shaft for winding the medium;

a shaft adjusting mechanism configured to adjust the position of the winding shaft;

a notifying unit configured to perform notification about information of a device; and a controller configured to image, by the imaging unit, a measurement pattern of a jig locked to the medium supporting unit along a transporting path at both ends in a width direction of the medium with one end of the jig being attached to the winding shaft, the pattern being imaged at two locations different from each other in a direction orthogonal to the transporting direction of the medium on the medium supporting unit, determine necessity of position adjustment of the winding shaft based on the image imaged by the imaging unit, and perform notification, at the notifying unit, about the determination result.

* * * * *